US009257088B2

(12) United States Patent
Cho et al.

(10) Patent No.: US 9,257,088 B2
(45) Date of Patent: Feb. 9, 2016

(54) DISPLAY PANEL AND METHOD OF DRIVING THE SAME

(71) Applicant: Samsung Display Co., Ltd., Yongin, Gyeonggi-do (KR)

(72) Inventors: Se-Hyoung Cho, Hwaseong-si (KR); Joon-Chul Goh, Hwaseong-si (KR); Mee-Hye Jung, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/454,646

(22) Filed: Aug. 7, 2014

(65) Prior Publication Data

US 2015/0194120 A1 Jul. 9, 2015

(30) Foreign Application Priority Data

Jan. 9, 2014 (KR) ..... 10-2014-0002978

(51) Int. Cl.
*G09G 3/36* (2006.01)

(52) U.S. Cl.
CPC ..... *G09G 3/3696* (2013.01); *G09G 3/3607* (2013.01); *G09G 2300/0439* (2013.01); *G09G 2300/0478* (2013.01); *G09G 2320/0247* (2013.01)

(58) Field of Classification Search
CPC .. G09G 3/3648; G09G 3/2011; G09G 3/3688
See application file for complete search history.

(56) References Cited

U.S. PATENT DOCUMENTS

| | | | |
|---|---|---|---|
| 2011/0261028 | A1 | 10/2011 | Goh et al. |
| 2012/0105785 | A1 | 5/2012 | Kim et al. |
| 2012/0320019 | A1 | 12/2012 | Jeong et al. |
| 2013/0113787 | A1 | 5/2013 | Shin et al. |
| 2013/0182018 | A1 | 7/2013 | Jeong et al. |

FOREIGN PATENT DOCUMENTS

| | | | |
|---|---|---|---|
| KR | 10-2008-0092570 | A | 10/2008 |
| KR | 10-2010-0042359 | A | 4/2010 |
| KR | 10-2012-0070986 | A | 7/2012 |

*Primary Examiner* — Ricardo L Osorio
(74) *Attorney, Agent, or Firm* — Christie, Parker & Hale, LLP

(57) ABSTRACT

A display panel includes: a first pixel including: a first high pixel configured to represent a first high gray level; and a first low pixel configured to represent a first low gray level; and a second pixel adjacent the first pixel in a first direction, the second pixel including: a second high pixel configured to represent a second high gray level based on a second data voltage and the common voltage in response to the first gate signal; and a second low pixel configured to represent a second low gray level based on the second data voltage, the common voltage, and a second divided voltage different from the first divided voltage in response to the first gate signal.

20 Claims, 10 Drawing Sheets

DISPLAY PANEL AND METHOD OF DRIVING THE SAME

CROSS-REFERENCE TO RELATED APPLICATION

This application claims priority to and the benefit of Korean Patent Application No. 10-2014-0002978, filed on Jan. 9, 2014 in the Korean Intellectual Property Office KIPO, the content of which is herein incorporated by reference in its entirety.

BACKGROUND

1. Field

Example embodiments of the present inventive concept relate to a display panel and a method of driving the display panel.

2. Description of the Related Art

Generally, a liquid crystal display ("LCD") apparatus may include a first substrate including a pixel electrode, a second substrate including a common electrode, and a liquid crystal layer between the first and second substrates. An electric field is generated by voltages applied to the pixel electrode and the common electrode. By adjusting an intensity of the electric field, a transmittance of light passing through the liquid crystal layer may be adjusted so that a desired image may be displayed.

In a vertical alignment configuration LCD apparatus, a unit pixel of a display panel is divided into a high pixel and a low pixel to improve a side visibility.

A ratio between a high pixel voltage and a low pixel voltage may be established by a ratio between sizes of thin film transistors according to the design of the pixels so that the low pixel voltage is not driven independently from the high pixel voltage. Thus, improvement of the side visibility may be limited.

SUMMARY

Aspects of example embodiments of the present invention include a display panel improving a side visibility.

Aspects of example embodiments of the present invention include a method of driving the display panel.

Aspects of example embodiments of the present invention include a display panel including: a first pixel including: a first high pixel configured to represent a first high gray level based on a first data voltage and a common voltage in response to a first gate signal; and a first low pixel configured to represent a first low gray level based on the first data voltage, the common voltage, and a first divided voltage in response to the first gate signal; and a second pixel adjacent the first pixel in a first direction, the second pixel including: a second high pixel configured to represent a second high gray level based on a second data voltage and the common voltage in response to the first gate signal; and a second low pixel configured to represent a second low gray level based on the second data voltage, the common voltage, and a second divided voltage different from the first divided voltage in response to the first gate signal.

The first high pixel may include: a first high pixel electrode; and a first high switching element coupled to: a first gate line configured to apply the first gate signal; a first data line configured to apply the first data voltage; and the first high pixel electrode, wherein the first low pixel may include: a first low pixel electrode; a first low switching element coupled to the first gate line, the first data line, and the first low pixel electrode; and a second low switching element coupled to the first gate line, the first low pixel electrode, and a first divided voltage line configured to apply the first divided voltage.

The first divided voltage line may extend parallel to the first data line, and the first divided voltage line may be between the first data line and the second data line.

The first divided voltage line may be at a same layer as the first data line and the second data line.

When the first data voltage represents a same gray level as a gray level represented by the second data voltage, during a first frame, the first high pixel may be configured to represent a gray level of H, the first low pixel may be configured to represent a gray level of L that is less than the gray level of H, the second high pixel may be configured to represent the gray level of H, and the second low pixel may be configured to represent a gray level of L2 that is different from the gray level of L, and during a second frame, the first high pixel may be configured to represent a gray level of M that is different from the gray level of H, the first low pixel may be configured to represent a gray level of LM that is less than the gray level of M and different from the gray level of L, the second high pixel may be configured to represent the gray level of M, and the second low pixel may be configured to represent a gray level of LM2 that is different from the gray level of LM.

The display panel may further include: a third pixel including: a third high pixel configured to represent a third high gray level based on a third data voltage and the common voltage in response to the first gate signal; and a third low pixel configured to represent a third low gray level based on the third data voltage, the common voltage, and the first divided voltage in response to the first gate signal; and a fourth pixel including: a fourth high pixel configured to represent a fourth high gray level based on a fourth data voltage and the common voltage in response to the first gate signal; and a fourth low pixel configured to represent a fourth low gray level based on the fourth data voltage, the common voltage, and the second divided voltage in response to the first gate signal.

When the first data voltage, the second data voltage, the third data voltage and the fourth data voltage represent a same gray level as one another, during a first frame, the first high pixel may be configured to represent a gray level of H, the first low pixel may be configured to represent a gray level of L that is less than the gray level of H, the second high pixel may be configured to represent the gray level of H, the second low pixel may be configured to represent a gray level of L2 that is different from the gray level of L, the third high pixel may be configured to represent a gray level of M that is different from the gray level of H, the third low pixel may be configured to represent a gray level of LM that is less than the gray level of M and different from the gray level of L, the fourth high pixel may be configured to represent the gray level of M and the fourth low pixel may be configured to represent a gray level of LM2 that is different from the gray level of LM, and during a second frame, the first high pixel may be configured to represent the gray level of M, the first low pixel is configured to represent the gray level of LM, the second high pixel may be configured to represent the gray level of M, the second low pixel may be configured to represent the gray level of LM2, the third high pixel may be configured to represent the gray level of H, the third low pixel may be configured to represent the gray level of L, the fourth high pixel may be configured to represent the gray level of H, and the fourth low pixel may be configured to represent the gray level of L2.

The first divided voltage and the second divided voltage may be changed in a cycle having a width of two gate signals.

The display panel may further include: a third pixel, a fifth pixel, and a seventh pixel sequentially positioned along a second direction which crosses the first direction from the first pixel; and a fourth pixel, a sixth pixel, and an eighth pixel sequentially positioned along the second direction from the second pixel, and the display panel may further include: a first data line configured to apply the first data voltage and coupled to the first pixel and the third pixel; and a second data line configured to apply the second data voltage and coupled to the second pixel, the fourth pixel, the fifth pixel and the seventh pixel.

The first divided voltage and the second divided voltage may be changed in a cycle having a width of a gate signal.

The display panel may further include: a third pixel, a fifth pixel, and a seventh pixel sequentially positioned along a second direction which crosses the first direction from the first pixel; a fourth pixel, a sixth pixel and an eighth pixel sequentially positioned along the second direction from the second pixel; a first data line configured to apply the first data voltage and coupled to the first pixel and the fifth pixel; and a second data line configured to apply the second data voltage and coupled to the second pixel, the third pixel, the sixth pixel, and the seventh pixel.

A cycle of swing of the first divided voltage may be the same as a cycle of swing of the second divided voltage, and a width of swing of the first divided voltage may be the same as a width of swing of the second divided voltage.

Aspects of example embodiments of the present invention include a method of driving a display panel, the method including: displaying a first high gray level on a first high pixel based on a first data voltage and a common voltage in response to a first gate signal; displaying a first low gray level on a first low pixel based on the first data voltage, the common voltage, and a first divided voltage in response to the first gate signal; displaying a second high gray level on a second high pixel based on a second data voltage and the common voltage in response to the first gate signal; and displaying a second low gray level on a second low pixel based on the second data voltage, the common voltage, and a second divided voltage that is different from the first divided voltage in response to the first gate signal.

The first high pixel may include: a first high pixel electrode; a first high switching element coupled to: a first gate line configured to apply the first gate signal; a first data line configured to apply the first data voltage; and the first high pixel electrode, wherein the first low pixel comprises: a first low pixel electrode; a first low switching element coupled to the first gate line, the first data line, and the first low pixel electrode; and a second low switching element coupled to the first gate line, the first low pixel electrode, and a first divided voltage line configured to apply the first divided voltage.

The first divided voltage and the second divided voltage may be changed for adjacent frames.

When the first data voltage represents a same gray level as the second data voltage, during a first frame, the first high pixel may be configured to represent a gray level of H, the first low pixel may be configured to represent a gray level of L that is less than the gray level of H, the second high pixel may be configured to represent the gray level of H, and the second low pixel may be configured to represent a gray level of L2 that is different from the gray level of L, and during a second frame, the first high pixel may be configured to represent a gray level of M that is different from the gray level of H, the first low pixel may be configured to represent a gray level of LM that is less than the gray level of M and different from the gray level of L, the second high pixel may be configured to represent the gray level of M, and the second low pixel may be configured to represent a gray level of LM2 that is different from the gray level of LM.

The first divided voltage and the second divided voltage may be changed in a cycle having a width of two gate signals.

The first divided voltage and the second divided voltage may be changed in a cycle having a width of a gate signal.

A cycle of swing of the first divided voltage may be the same as a cycle of swing of the second divided voltage, and a width of swing of the first divided voltage may be the same as a width of swing of the second divided voltage.

With the display panel and the method of driving the display panel, according to aspects of embodiments of the present invention, a gray level of a low pixel may be set by adjusting a divided voltage applied to the low pixel. Accordingly, the gray levels may be represented or displayed based on various gamma values. Therefore, the side visibility of the display panel may be improved.

BRIEF DESCRIPTION OF THE DRAWINGS

The above and other features and aspects of the present invention will become more apparent by describing example embodiments thereof with reference to the accompanying drawings, in which.

DETAILED DESCRIPTION

Hereinafter, the present inventive concept will be explained in some detail with reference to the accompanying drawings.

Figure 1:
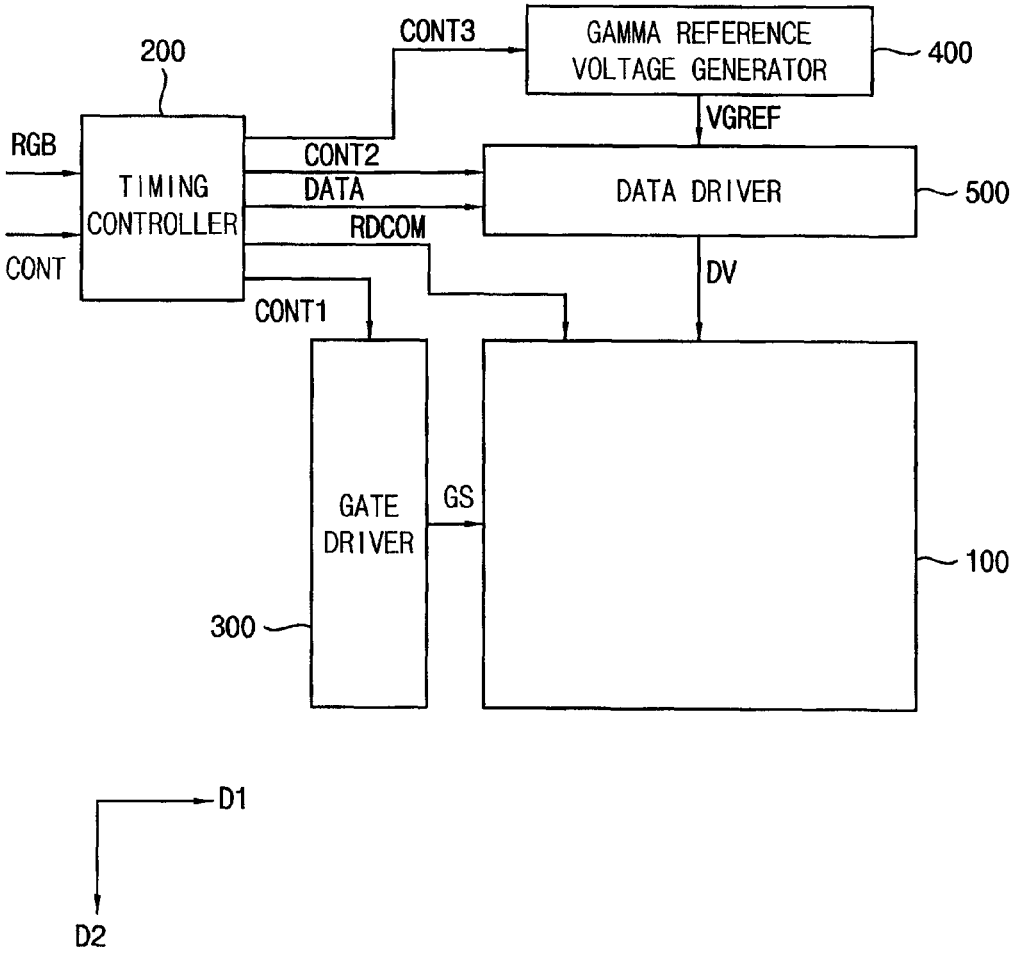
FIG. 1 is a block diagram illustrating a display apparatus according to an example embodiment of the present invention.

FIG. 1 is a block diagram illustrating a display apparatus according to an example embodiment of the present inventive concept.

Referring to FIG. 1, the display apparatus includes a display panel 100 and a panel driver. The panel driver includes a timing controller 200, a gate driver 300, a gamma reference voltage generator 400 and a data driver 500.

The display panel 100 has a display region on which an image is displayed and a peripheral region adjacent to the display region.

The display panel 100 includes a plurality of gate lines, a plurality of data lines and a plurality of pixels coupled to the gate lines and the data lines. The gate lines extend in a first direction D1 and the data lines extend in a second direction D2 crossing the first direction D1. The display panel 100 may further include a divided voltage line extending parallel to the data lines.

Each pixel includes a high pixel and a low pixel. The pixels may be arranged in a matrix form. A pixel structure is explained referring to FIGS. 2, 3A and 3B in more detail.

The timing controller 200 receives input image data RGB and an input control signal CONT from an external apparatus (not shown). The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 may generate a high data signal having a high gamma based on the input image data RGB. The timing controller 200 may generate a low data signal having a low gamma based on the input image data RGB. The timing controller may selectively output the high data signal and the low data signal to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The timing controller 200 may further include a voltage generating part (or voltage generator). The voltage generating part generates a divided voltage RDCOM. The voltage generating part provides the divided voltage RDCOM to the display panel 100. The voltage generating part may generate a common voltage. The voltage generating part may provide the common voltage to the display panel 100. In an example embodiment, the voltage generating part may be located in the timing controller 200. Alternatively, the voltage generating part may be located outside of (e.g., externally with respect to) the timing controller 200.

The gate driver 300 generates gate signals GS driving the gate lines in response to the first control signal CONT1 received from the timing controller 200. The gate driver 300 sequentially outputs the gate signals GS to the gate lines.

The gate driver 300 may be directly (or indirectly) mounted on the display panel 100, or may be coupled to the display panel 100 as a tape carrier package ("TCP") configuration. Alternatively, the gate driver 300 may be integrated on or into the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be located in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages VD having an analog value using the gamma reference voltages VGREF. The data driver 500 outputs the data voltages VD to the data lines DL.

The data driver 500 may be directly (or indirectly) mounted on the display panel 100, or be coupled to the display panel 100 in a TCP configuration. Alternatively, the data driver 500 may be integrated on the display panel 100.

Figure 2:
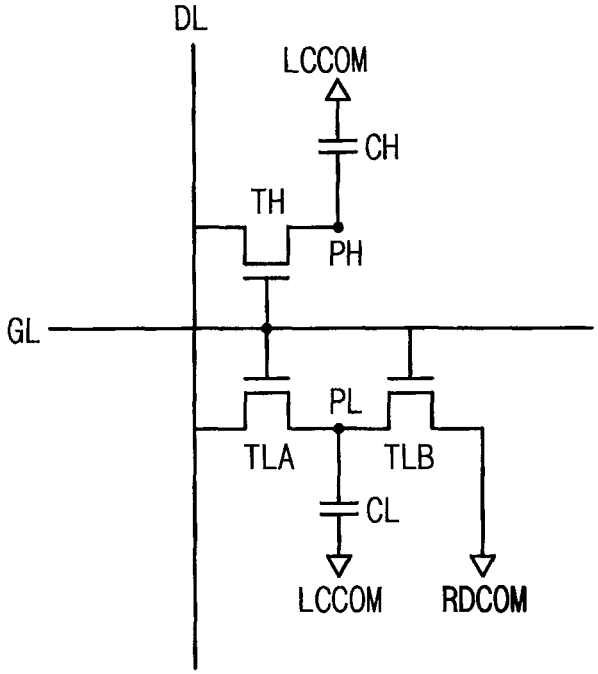
FIG. 2 is a circuit diagram illustrating a pixel of the display panel of FIG. 1.
Figure 3A:
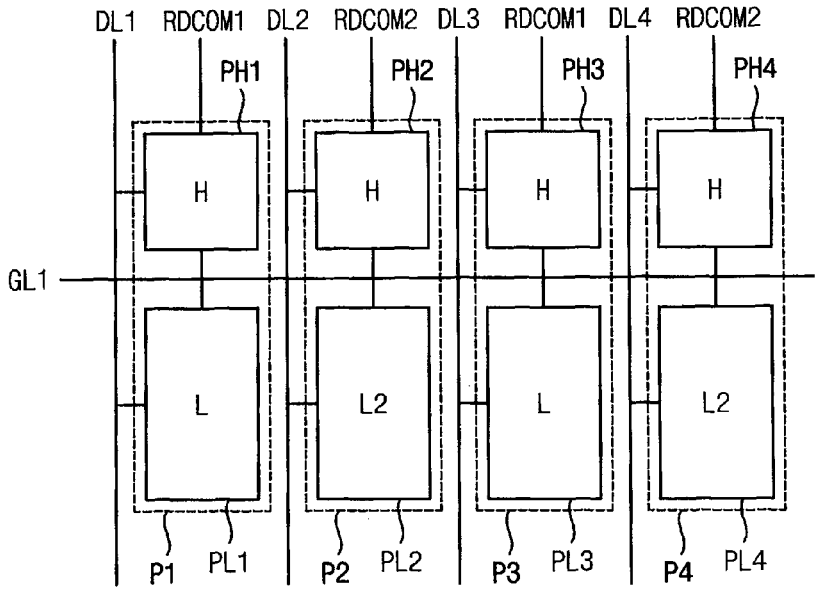
FIG. 3A is a plan view illustrating a pixel structure of the display panel of FIG. 1 and gray levels displayed by the pixels during a first frame.
Figure 3B:
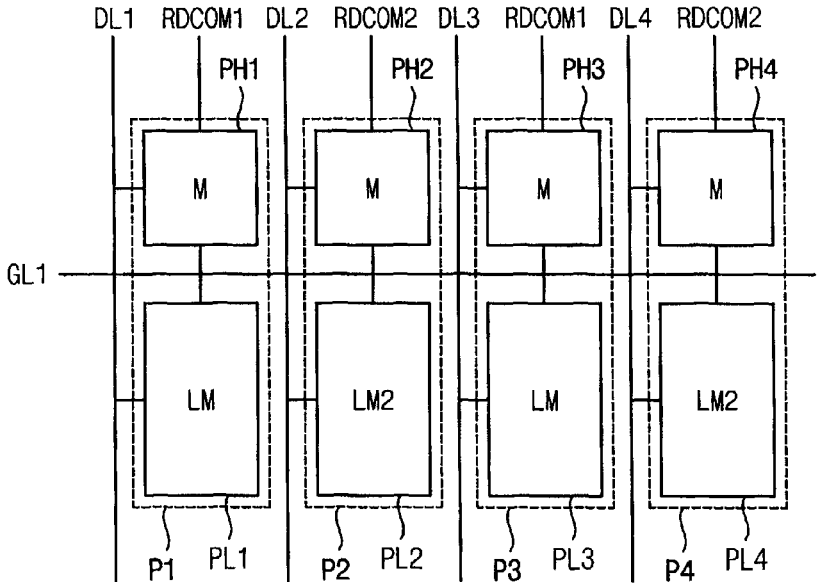
FIG. 3B is a plan view illustrating the pixel structure of the display panel of FIG. 1 and gray levels displayed by the pixels during a second frame.

FIG. 2 is a circuit diagram illustrating a pixel of the display panel 100 of FIG. 1. FIG. 3A is a plan view illustrating a pixel structure of the display panel 100 of FIG. 1 and gray levels displayed by the pixels during a first frame FR1. FIG. 3B is a plan view illustrating the pixel structure of the display panel 100 of FIG. 1 and gray levels displayed by the pixels during a second frame FR2.

Referring to FIGS. 1 to 3B, the display panel 100 includes a plurality of pixels. The pixel includes the high pixel and the low pixel.

The high pixel includes a high switching element TH, a high pixel electrode PH and a high liquid crystal capacitor CH.

The high switching element TH is coupled to the gate line GL, the data line DL and the high pixel electrode PH. The high switching element TH may be a thin film transistor.

The high switching element TH may include a gate electrode coupled to the gate line GL, a source electrode coupled to the data line DL and a drain electrode coupled to the high pixel electrode PH.

A first end of the high liquid crystal capacitor CH is coupled to the high pixel electrode PH. The common voltage LCCOM is applied to a second end of the high liquid crystal capacitor CH.

The low pixel includes a first low switching element TLA, a second low switching element TLB, a low pixel electrode PL and a low liquid crystal capacitor CL.

The first low switching element TLA is coupled to the gate line GL, the data line DL and the low pixel electrode PL. The first low switching element TLA may be a thin film transistor.

The first low switching element TLA may include a gate electrode coupled to the gate line GL, a source electrode coupled to the data line DL and a drain electrode coupled to the low pixel electrode PL.

A first end of the low liquid crystal capacitor CL is coupled to the low pixel electrode PL. The common voltage LCCOM is applied to a second end of the high liquid crystal capacitor CH.

The second low switching element TLB is coupled to the first low switching element TLA in series. The second low switching element TLB is coupled to the gate line GL, the low pixel electrode PL and the divided voltage line applying the divided voltage RDCOM.

The second low switching element TLB may include a gate electrode coupled to the gate line GL, a source electrode coupled to the low pixel electrode PL and a drain electrode to which the divided voltage RDCOM is applied.

In the high pixel, the data voltage is applied to the high pixel electrode PH. In the low pixel, the data voltage is divided by the first low switching element TLA and the second low switching element TLB, which are coupled with each other in series. Accordingly, a voltage less than the data voltage is applied to the low pixel electrode PL.

When a resistance of the first low switching element TLA is RA, a resistance of the second low switching element TLB is RB, the data voltage is VD, and a voltage between the drain electrode and the source electrode of the first low switching element TLA is VA, a voltage VPL applied to the low pixel electrode PL may be determined as according to the following Equation 1.

$$VPL = \frac{RB}{RA + RB} \times VD + \frac{RA}{RA + RB} \times RDCOM \quad \text{[Equation 1]}$$

The voltage VPL of the low pixel PL may be determined by the resistance of the first low switching element TLA, the resistance of the second low switching element TLB, and the divided voltage RDCOM. The resistance of the first low switching element TLA and the resistance of the second low switching element TLB may be determined by a width/length ("W/L") ratio of the first switching element TLA and a W/L ratio of the second switching element TLB.

In FIGS. 3A and 3B, four pixels adjacent in (or along) the first direction D1 are illustrated.

A first pixel P1 includes a first high pixel PH1 and a first low pixel PL1. A second pixel P2 is adjacent to the first pixel P1 in the first direction D1. The second pixel P2 includes a second high pixel PH2 and a second low pixel PL2. A third pixel P3 is adjacent to the second pixel P2 in the first direction D1. The third pixel P3 includes a third high pixel PH3 and a third low pixel PL3. A fourth pixel P4 is adjacent to the third pixel P3 in the first direction D1. The fourth pixel P4 includes a fourth high pixel PH4 and a fourth low pixel PL4.

The first pixel P1 is coupled to a first gate line GL1 applying a first gate signal, a first data line DL1 applying a first data voltage and a first divided voltage line applying a first divided voltage RDCOM1.

The first high pixel PH1 represents (or displays) a first high gray level based on the first data voltage and the common voltage LCCOM in response to the first gate signal.

The first low pixel PL1 represents (or displays) a first low gray level based on the first data voltage, the common voltage LCCOM and the first divided voltage RDCOM1 in response to the first gate signal.

The second pixel P2 is coupled to the first gate line GL1, a second data line DL2 applying a second data voltage and a second divided voltage line applying a second divided voltage RDCOM2 different from the first divided voltage RDCOM1.

The second high pixel PH2 represents a second high gray level based on the second data voltage and the common voltage LCCOM in response to the first gate signal.

The second low pixel PL2 represents a second low gray level based on the second data voltage, the common voltage LCCOM and the second divided voltage RDCOM2 in response to the first gate signal.

The third pixel P3 is coupled to the first gate line GL1, a third data line DL3 applying a third data voltage and a third divided voltage line applying the first divided voltage RDCOM1.

The third high pixel PH3 represents a third high gray level based on the third data voltage and the common voltage LCCOM in response to the first gate signal.

The third low pixel PL3 represents a third low gray level based on the third data voltage, the common voltage LCCOM and the first divided voltage RDCOM1 in response to the first gate signal.

The fourth pixel P4 is coupled to the first gate line GL1, a fourth data line DL4 applying a fourth data voltage and a fourth divided voltage line applying the second divided voltage RDCOM2.

The fourth high pixel PH4 represents a fourth high gray level based on the fourth data voltage and the common voltage LCCOM in response to the first gate signal.

The fourth low pixel PL4 represents a fourth low gray level based on the fourth data voltage, the common voltage LCCOM and the second divided voltage RDCOM2 in response to the first gate signal.

In the present example embodiment, the first divided voltage RDCOM1 applied to the first low pixel PL1 is different from the second divided voltage RDCOM2 applied to the second low pixel PL2. Thus, when the first data voltage is substantially the same as the second data voltage, a gray level of the first high pixel PH1 may be substantially the same as a gray level of the second high pixel PH2. In contrast, when the first data voltage is substantially the same as the second data voltage, a gray level of the first low pixel PL1 may be different from a gray level of the second low pixel PL2.

In FIGS. 3A and 3B, for example, the first data voltage is substantially the same as the second data voltage. In addition, for example, the first data voltage and the second data voltage maintain the same gray level during the first to second frames.

During the first frame, the first high pixel PH1 represents a gray level of H, the first low pixel PL1 represents a gray level of L which is less than the gray level of H, the second high pixel PH2 represents the gray level of H and the second low pixel represents a gray level of L2 which is different from the gray level of L.

During the second frame, the first high pixel PH1 represents a gray level of M which is different from the gray level of H, the first low pixel PL1 represents a gray level of LM which is less than the gray level of M and different from the gray level of L, the second high pixel PH2 represents the gray level of M and the second low pixel represents a gray level of LM2 which is different from the gray level of LM.

For example, the gray level of M may be less than the gray level of H. The gray level of LM may be less than the gray level of L.

During the first frame, the first pixel P1 and the second pixel P2 of the display panel 100 may display three different gray levels of H, L and L2. During the second frame, the first pixel P1 and the second pixel P2 of the display panel 100 may display three different gray levels of M, LM and LM2.

The first pixel P1 and the second pixel P2 of the display panel 100 may represent a gray level value using six gray levels of H, L, L2, M, LM, and LM2. Thus, the side visibility of the display panel 100 may be improved.

Although, in the present example embodiment, the high pixel representing the gray level of H represents the gray level of M in a next frame, the high pixel representing the gray level of M represents the gray level of H in a next frame, the low pixel representing the gray level of L represents the gray level of LM in a next frame, the low pixel representing the gray level of LM represents the gray level of L in a next frame, the low pixel representing the gray level of L2 represents the gray level of LM2 in a next frame, the low pixel representing the gray level of LM2 represents the gray level of L2 in a next frame, the present invention is not limited thereto. The first divided voltage RDCOM1 and the second divided voltage RDCOM2 may be properly adjusted so that the gray level in a next frame may be freely adjusted according to the first and second divided voltages RDCOM1 and RDCOM2.

Figure 4:
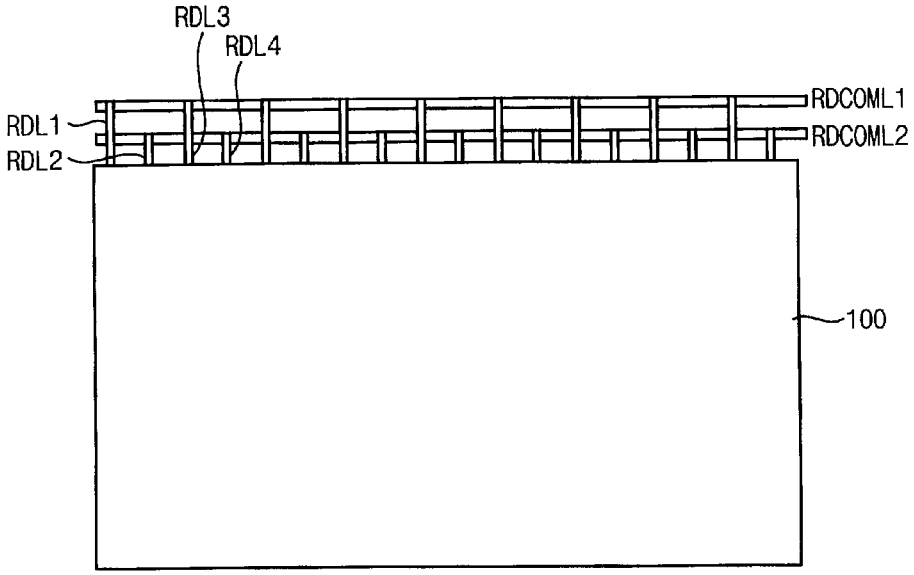
FIG. 4 is a plan view illustrating the display panel of FIG. 1 and a divided voltage wiring structure.

FIG. 4 is a plan view illustrating the display panel 100 of FIG. 1 and a divided voltage wiring structure.

Referring to FIGS. 1 to 4, the first divided voltage RDCOM1 may be applied to an odd-numbered pixel column and the second divided voltage RDCOM2 may be applied to an even-numbered pixel column. A first divided voltage line RDL1 may be coupled to a first pixel column including the first pixel P1. A second divided voltage line RDL2 may be coupled to a second pixel column including the second pixel P2. A third divided voltage line RDL3 may be coupled to a third pixel column including the third pixel P3. A fourth divided voltage line RDL4 may be coupled to a fourth pixel column including the fourth pixel P4.

The first divided voltage RDCOM1 is applied to a first divided voltage common line RDCOML1. The first divided voltage RDCOM1 may be provided to the odd-numbered pixel columns through odd-numbered divided voltage line RDL1 and RDL3. The second divided voltage RDCOM2 is applied to a second divided voltage common line RDCOML2. The second divided voltage RDCOM2 may be provided to the even-numbered pixel columns through even-numbered divided voltage line RDL2 and RDL4.

The divided voltage lines RDL1 to RDL4 may extend in a direction parallel (or substantially parallel) to the data line. Each of the divided voltage lines RDL1 to RDL4 may be positioned between the adjacent data lines.

For example, the first divided voltage line RDL1 may be located between the first data line DL1 and the second data line DL2. The second divided voltage line RDL2 may be located between the second data line DL2 and the third data line DL3.

The divided voltage lines RDL1 to RDL4 may be located on a substrate on which the high switching element TH, the first low switching element TLA and the second low switching element TLB are formed.

For example, the divided voltage lines RDL1 to RDL4 may be located on a layer same as the data line. For example, the divided voltage lines RDL1 to RDL4 and the data line may be formed from the same metal layer.

Figure 5:
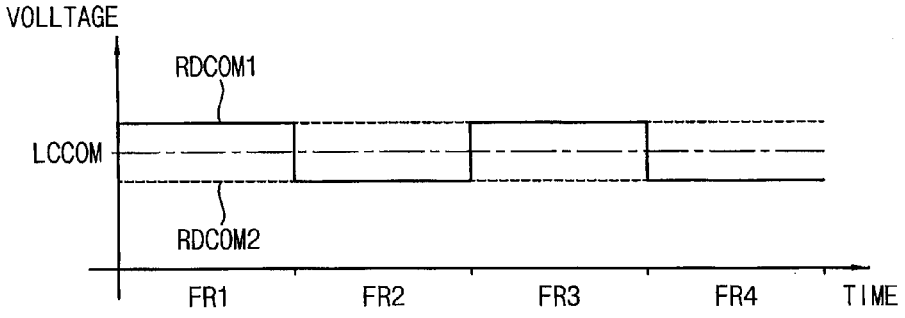
FIG. 5 is a waveform diagram illustrating a first divided voltage and a second divided voltage applied to the display panel of FIG. 1.

FIG. 5 is a waveform diagram illustrating the first divided voltage RDCOM1 and the second divided voltage RDCOM2 applied to the display panel 100 of FIG. 1.

Referring to FIGS. 1 to 5, a value of the first divided voltage RDCOM1 and a value of the second divided voltage RDCOM2 may be changed for each adjacent frame.

For example, a width of swing of the first divided voltage RDCOM1 may be substantially the same as a width of swing of the second divided voltage RDCOM2. Alternatively, the width of swing of the first divided voltage RCOM1 may be different from the width of swing of the second divided voltage RDCOM2.

A high level of the first divided voltage RDCOM1 in the first frame FR1 may be substantially the same as a high level of the second divided voltage RDCOM2 in the second frame FR2. Alternatively, a high level of the first divided voltage RDCOM1 in the first frame FR1 may be different from a high level of the second divided voltage RDCOM2 in a second frame FR2.

For example, one of the first divided voltage RDCOM1 and the second divided voltage RDCOM2 may be greater than the common voltage LCCOM and the other may be less than the common voltage LCCOM in the first frame FR1.

Similarly, one of the first divided voltage RDCOM1 and the second divided voltage RDCOM2 may be greater than the common voltage LCCOM, and the other may be less than the common voltage LCCOM in the during frame FR2.

The display panel 100 may be driven in an inversion driving method in every frame. The display panel 100 may be driven in a column inversion driving method such that pixels in an odd-numbered pixel column have the same polarities as one another and pixels in an even-numbered pixel column have the same polarities as one another.

According to the present example embodiment, the divided voltage applied to the low pixel is adjusted to set the gray level of the low pixel. The different divided voltages RDCOM1 and RDCOM2 are applied to the first low pixel and the second low pixel which are adjacent to each other so that a first low gray level and a second low gray level may be different from each other for the same data voltage. Thus, a side visibility of the display panel 100 may be improved.

In addition, one gray level may be represented using further more gray levels by the time division method. Thus, a side visibility of the display panel 100 may be further improved.

Figure 6A:
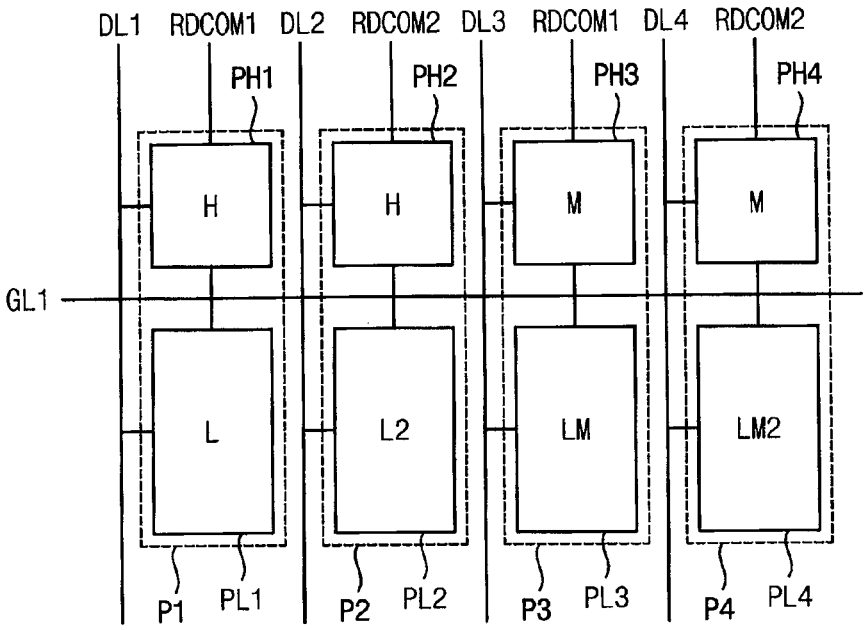
FIG. 6A is a plan view illustrating a pixel structure of a display panel according to an example embodiment of the present inventive concept and gray levels displayed by the pixels during a first frame.
Figure 6B:
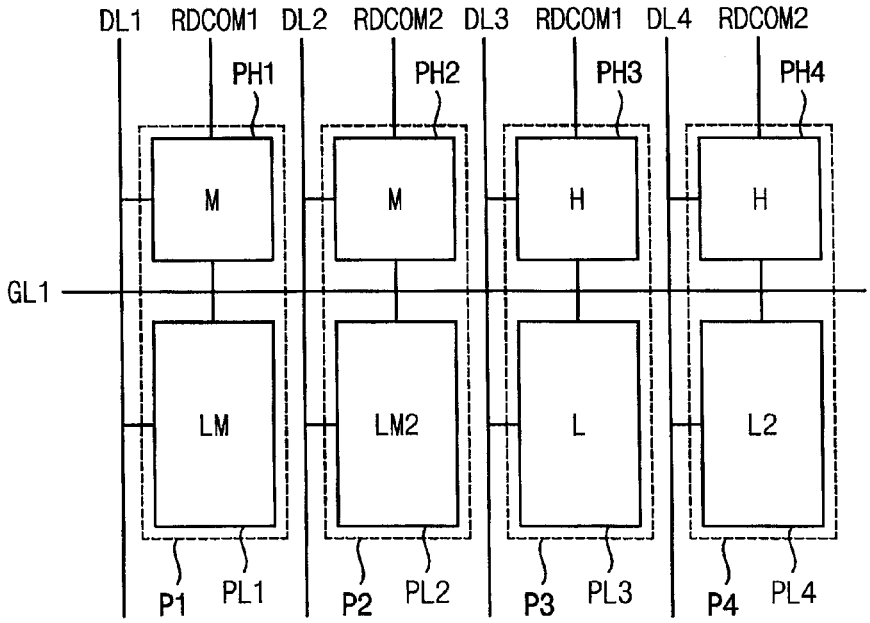
FIG. 6B is a plan view illustrating the pixel structure of the display panel of FIG. 6A and gray levels displayed by the pixels during a second frame.
Figure 7:
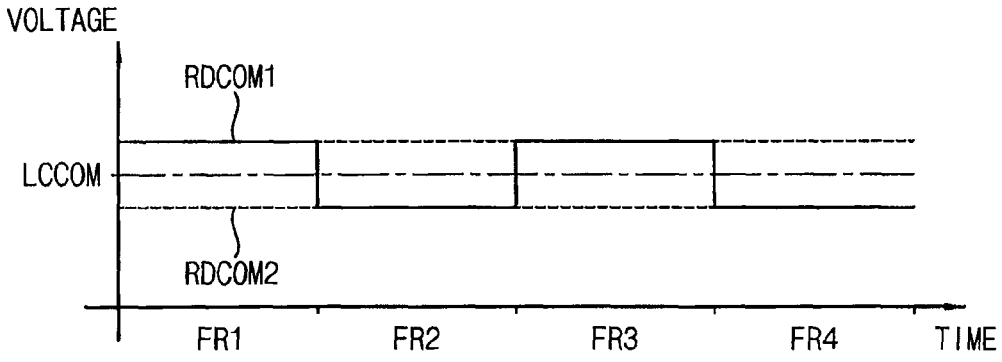
FIG. 7 is a waveform diagram illustrating a first divided voltage and a second divided voltage applied to the display panel of FIG. 6A.

FIG. 6A is a plan view illustrating a pixel structure of a display panel according to an example embodiment of the present inventive concept and gray levels displayed by the pixels during a first frame. FIG. 6B is a plan view illustrating the pixel structure of the display panel of FIG. 6A and gray levels displayed by the pixels during a second frame. FIG. 7 is a waveform diagram illustrating a first divided voltage and a second divided voltage applied to the display panel of FIG. 6A.

The display apparatus according to the present example embodiment is substantially the same as the display apparatus of the previous example embodiment explained referring to FIGS. 1 to 5 except for the pixel structure of the display panel. Thus, the same reference numerals will be used to refer to the same or like parts as those described in the previous example embodiment of FIGS. 1 to 5 and some repetitive explanation concerning the above elements will be omitted.

Referring to FIGS. 1, 2, 6A, 6B and 7, the display apparatus includes a display panel 100 and a panel driver. The panel driver includes a timing controller 200, a gate driver 300, a gamma reference voltage generator 400 and a data driver 500.

The display panel 100 includes a plurality of pixels. Each of the pixels includes a high pixel and a low pixel.

The high pixel includes a high switching element TH, a high pixel electrode PH and a high liquid crystal capacitor CH.

The low pixel includes a first low switching element TLA, a second low switching element TLB, a low pixel electrode PL and a low liquid crystal capacitor CL.

In FIGS. 6A and 6B, four pixels adjacent in (or along) the first direction D1 are illustrated.

A first pixel P1 includes a first high pixel PH1 and a first low pixel PL1. A second pixel P2 is adjacent to the first pixel P1 in the first direction D1. The second pixel P2 includes a second high pixel PH2 and a second low pixel PL2. A third pixel P3 is adjacent to the second pixel P2 in the first direction D1. The third pixel P3 includes a third high pixel PH3 and a third low pixel PL3. A fourth pixel P4 is adjacent to the third pixel P3 in the first direction D1. The fourth pixel P4 includes a fourth high pixel PH4 and a fourth low pixel PL4.

The first pixel P1 is coupled to a first gate line GL1 applying a first gate signal, a first data line DL1 applying a first data voltage and a first divided voltage line applying a first divided voltage RDCOM1.

The first high pixel PH1 represents a first high gray level based on the first data voltage and the common voltage LCCOM in response to the first gate signal.

The first low pixel PL1 represents a first low gray level based on the first data voltage, the common voltage LCCOM and the first divided voltage RDCOM1 in response to the first gate signal.

The second pixel P2 is coupled to the first gate line GL1, a second data line DL2 applying a second data voltage and a second divided voltage line applying a second divided voltage RDCOM2 different from the first divided voltage RDCOM1.

The second high pixel PH2 represents a second high gray level based on the second data voltage and the common voltage LCCOM in response to the first gate signal.

The second low pixel PL2 represents a second low gray level based on the second data voltage, the common voltage LCCOM and the second divided voltage RDCOM2 in response to the first gate signal.

The third pixel P3 is coupled to the first gate line GL1, a third data line DL3 applying a third data voltage and a third divided voltage line applying the first divided voltage RDCOM1.

The third high pixel PH3 represents a third high gray level based on the third data voltage and the common voltage LCCOM in response to the first gate signal.

The third low pixel PL3 represents a third low gray level based on the third data voltage, the common voltage LCCOM and the first divided voltage RDCOM1 in response to the first gate signal.

The fourth pixel P4 is coupled to the first gate line GL1, a fourth data line DL4 applying a fourth data voltage and a fourth divided voltage line applying the second divided voltage RDCOM2.

The fourth high pixel PH4 represents a fourth high gray level based on the fourth data voltage and the common voltage LCCOM in response to the first gate signal.

The fourth low pixel PL4 represents a fourth low gray level based on the fourth data voltage, the common voltage LCCOM and the second divided voltage RDCOM2 in response to the first gate signal.

In the present example embodiment, the first divided voltage RDCOM1 applied to the first low pixel PL1 is different from the second divided voltage RDCOM2 applied to the second low pixel PL2. Thus, when the first data voltage represents a gray level substantially the same as the second data voltage, a gray level of the first high pixel PH1 may be substantially the same as a gray level of the second high pixel PH2. In contrast, when the first data voltage is substantially the same as the second data voltage, a gray level of the first low pixel PL1 may be different from a gray level of the second low pixel PL2.

In FIGS. 6A and 6B, for example, the first data voltage, the second data voltage, the third data voltage, and the fourth data voltage are substantially the same as one another. In addition, for example, the first data voltage, the second data voltage, the third data voltage, and the fourth data voltage maintain the same gray level during the first to second frames.

During the first frame: the first high pixel PH1 represents a gray level of H; the first low pixel PL1 represents a gray level of L, which is less than the gray level of H; the second high pixel PH2 represents the gray level of H; and the second low pixel represents a gray level of L2, which is different from the gray level of L. Additionally, during the first frame: the third high pixel PH3 represents a gray level of M, which is different from the gray level of H; the third low pixel PL3 represents a gray level of LM, which is less than the gray level of M and different from the gray level of L; the fourth high pixel PH4 represents the gray level of M; and the fourth low pixel represents a gray level of LM2, which is different from the gray level of LM.

The gray level of M may be less than the gray level of H. The gray level of LM may be less than the gray level of L.

During the second frame: the first high pixel PH1 represents the gray level of M; the first low pixel PL1 represents the gray level of LM; the second high pixel PH2 represents the gray level of M; and the second low pixel represents the gray level of LM2. Additionally, during the second frame: the third high pixel PH3 represents the gray level of H; the third low pixel PL3 represents the gray level of L; the fourth high pixel PH4 represents the gray level of H; and the fourth low pixel represents the gray level of L2.

During the first frame, the first to fourth pixels P1 to P4 of the display panel 100 may display six different gray levels of H, L, L2, M, LM and LM2. During the second frame, the first to fourth pixels P1 to P4 of the display panel 100 may display six different gray levels of H, L, L2, M, LM and LM2.

The first to fourth pixels P1 to P4 of the display panel 100 may represent a gray level value using six gray levels of H, L, L2, M, LM and LM2. In addition, the positions of the six different gray levels may be switched according to the frames. Thus, the side visibility of the display panel 100 may be improved.

A value of the first divided voltage RDCOM1 and a value of the second divided voltage RDCOM2 may be changed for each adjacent frame.

For example, a width of swing of the first divided voltage RDCOM1 may be substantially the same as a width of swing of the second divided voltage RDCOM2. Alternatively, the width of swing of the first divided voltage RCOM1 may be different from the width of swing of the second divided voltage RDCOM2.

A high level of the first divided voltage RDCOM1 in the first frame FR1 may be substantially the same as a high level of the second divided voltage RDCOM2 in the second frame FR2. Alternatively, a high level of the first divided voltage RDCOM1 in the first frame FR1 may be different from a high level of the second divided voltage RDCOM2 in a second frame FR2.

For example, one of the first divided voltage RDCOM1 and the second divided voltage RDCOM2 may be greater than the common voltage LCCOM, and the other may be less than the common voltage LCCOM in the first frame FR1.

Similarly, one of the first divided voltage RDCOM1 and the second divided voltage RDCOM2 may be greater than the common voltage LCCOM, and the other may be less than the common voltage LCCOM in the during frame FR2.

The display panel 100 may be driven in an inversion driving method in every frame. The display panel 100 may be driven in a column inversion driving method such that pixels in an odd-numbered pixel column have the same polarities as one another and pixels in an even-numbered pixel column have the same polarities as one another.

According to the present example embodiment, the divided voltage applied to the low pixel is adjusted to set the gray level of the low pixel. The different divided voltages RDCOM1 and RDCOM2 are applied to the first low pixel and the second low pixel which are adjacent to each other so that a first low gray level and a second low gray level may be different from each other for the same data voltage. Thus, a side visibility of the display panel 100 may be improved.

In addition, one gray level may be represented using additional gray levels by the time division method. Thus, a side visibility of the display panel 100 may be more improved.

Figure 8:
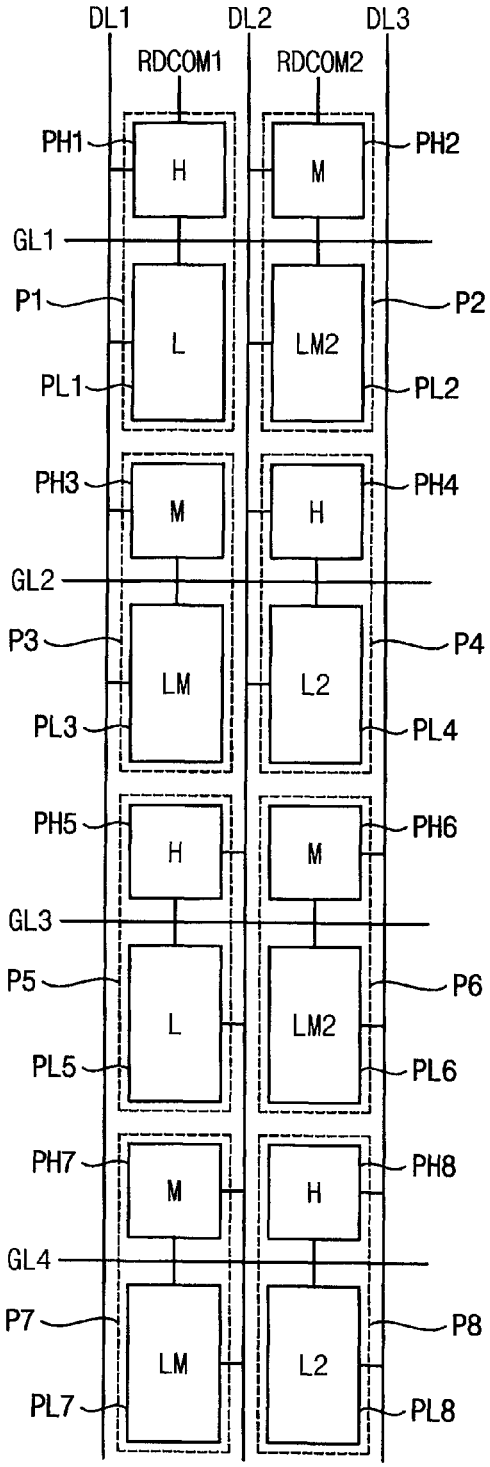
FIG. 8 is a plan view illustrating a pixel structure of a display panel according to an example embodiment of the present inventive concept.
Figure 9:
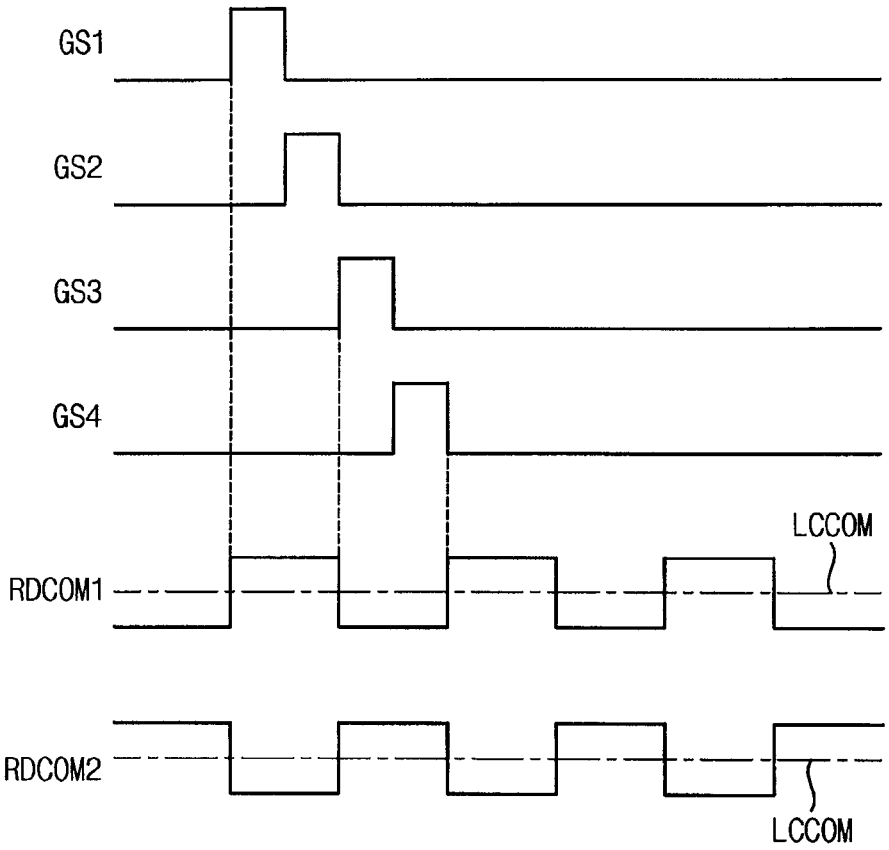
FIG. 9 is a waveform diagram illustrating a first divided voltage and a second divided voltage applied to the display panel of FIG. 8.

FIG. 8 is a plan view illustrating a pixel structure of a display panel according to an example embodiment of the present inventive concept. FIG. 9 is a waveform diagram illustrating a first divided voltage and a second divided voltage applied to the display panel of FIG. 8.

The display apparatus according to the present example embodiment is substantially the same as the display apparatus of the previous example embodiment explained referring to FIGS. 1 to 5 except for the pixel structure of the display panel and the waveforms of the first divided voltage and the second divided voltage. Thus, the same reference numerals will be used to refer to the same or like parts as those described in the previous example embodiment of FIGS. 1 to 5 and some repetitive explanation concerning the above elements will be omitted.

Referring to FIGS. 1, 2, 8, and 9, the display apparatus includes the display apparatus includes a display panel 100 and a panel driver. The panel driver includes a timing controller 200, a gate driver 300, a gamma reference voltage generator 400 and a data driver 500.

The display panel 100 includes a plurality of pixels. The pixel includes a high pixel and a low pixel.

The high pixel includes a high switching element TH, a high pixel electrode PH, and a high liquid crystal capacitor CH.

The low pixel includes a first low switching element TLA, a second low switching element TLB, a low pixel electrode PL and a low liquid crystal capacitor CL.

In FIG. 8, eight pixels arranged in a four by two matrix form are illustrated.

A first pixel P1 includes a first high pixel PH1 and a first low pixel PL1. A second pixel P2 is adjacent to the first pixel P1 in the first direction D1. The second pixel P2 includes a second high pixel PH2 and a second low pixel PL2. A third pixel P3 is adjacent to the first pixel P1 in the second direction D2. The third pixel P3 includes a third high pixel PH3 and a third low pixel PL3.

A fourth pixel P4 is adjacent to the third pixel P3 in the first direction D1. The fourth pixel P4 includes a fourth high pixel PH4 and a fourth low pixel PL4. A fifth pixel P5 is adjacent to the third pixel P3 in the second direction D2. The fifth pixel P5 includes a fifth high pixel PH5 and a fifth low pixel PL5.

A sixth pixel P6 is adjacent to the fifth pixel P5 in the first direction D1. The sixth pixel P6 includes a sixth high pixel PH6 and a sixth low pixel PL6. A seventh pixel P7 is adjacent to the fifth pixel P5 in the second direction D2. The seventh pixel P7 includes a seventh high pixel PH7 and a seventh low pixel PL7. An eighth pixel P8 is adjacent to the seventh pixel P7 in the first direction D1. The eighth pixel P8 includes an eighth high pixel PH8 and an eighth low pixel PL8.

For example, the pixels P1 to P8 may be arranged in a two dot alternating structure.

The first pixel P1 is coupled to a first gate line GL1 applying a first gate signal, a first data line DL1 applying a first data voltage, and a first divided voltage line applying a first divided voltage RDCOM1.

The first high pixel PH1 represents a first high gray level based on the first data voltage and the common voltage LCCOM in response to the first gate signal.

The first low pixel PL1 represents a first low gray level based on the first data voltage, the common voltage LCCOM and the first divided voltage RDCOM1 in response to the first gate signal.

The second pixel P2 is coupled to the first gate line GL1, a second data line DL2 applying a second data voltage, and a second divided voltage line applying a second divided voltage RDCOM2 different from the first divided voltage RDCOM1.

The second high pixel PH2 represents a second high gray level based on the second data voltage and the common voltage LCCOM in response to the first gate signal.

The second low pixel PL2 represents a second low gray level based on the second data voltage, the common voltage LCCOM and the second divided voltage RDCOM2 in response to the first gate signal.

The third pixel P3 is coupled to a second gate line GL2, the first data line DL1, and the first divided voltage line.

The fourth pixel P4 is coupled to the second gate line GL2, the second data line DL2, and the second divided voltage line.

The fifth pixel P5 is coupled to a third gate line GL3, the second data line DL2, and the first divided voltage line.

The sixth pixel P6 is coupled to the third gate line GL3, a third data line DL3 applying a third data signal, and the second divided voltage line.

The seventh pixel P7 is coupled to a fourth gate line GL4, the second data line DL2, and the first divided voltage line.

The eighth pixel P8 is coupled to the fourth gate line GL4, the third data line DL3, and the second divided voltage line.

In the present example embodiment, the first divided voltage RDCOM1 applied to the first low pixel PL1 is different from the second divided voltage RDCOM2 applied to the second low pixel PL2. Thus, when the data voltages applied to the eight pixels P1 to P8 are substantially the same as one another, a gray level of the first high pixel PH1 may be substantially the same as a gray level of the second high pixel PH2. In contrast, when the data voltages applied to the eighth pixels P1 to P8 are substantially the same as one another, a gray level of the first low pixel PL1 may be different from a gray level of the second low pixel PL2.

In FIG. 8, for example, the data voltages applied to the eight pixels P1 to P8 are substantially the same as one another.

During a frame, the first high pixel PH1 represents a gray level of H, the first low pixel PL1 represents a gray level of L, the second high pixel PH2 represents a gray level of M and the second low pixel PL2 represents a gray level of LM2. The third high pixel PH3 represents the gray level of M, the third low pixel PL3 represents a gray level of LM, the fourth high pixel PH4 represents the gray level of H and the fourth low pixel PL4 represents a gray level of L2. The fifth high pixel PH5 represents the gray level of H, the fifth low pixel PL5 represents the gray level of L, the sixth high pixel PH6 represents the gray level of M and the sixth low pixel PL6 represents the gray level of LM2. The seventh high pixel PH7 represents the gray level of M, the seventh low pixel PL7 represents the gray level of LM, the eighth high pixel PH8 represents the gray level of H and the eighth low pixel PL8 represents the gray level of L2.

During the next frame, the high pixel representing the gray level of H may represent the gray level of M, the high pixel representing the gray level of M may represent the gray level of H, the low pixel representing the gray level of L may represent the gray level of LM, the low pixel representing the gray level of LM may represent the gray level of L, the low pixel representing the gray level of L2 may represent the gray level of LM2 and the low pixel representing the gray level of LM2 may represent the gray level of L2.

However, the present inventive concept is not limited above-mentioned method. The first divided voltage RDCOM1 and the second divided voltage RDCOM2 may be properly adjusted so that the gray level in a next frame may be freely adjusted according to the first and second divided voltages RDCOM1 and RDCOM2.

The first to eighth pixels P1 to P8 of the display panel 100 may represent a gray level value using six gray levels of H, L, L2, M, LM, and LM2. In addition, the positions of the six gray levels may be changed according to the frames. Thus, the side visibility of the display panel 100 may be improved.

In the present example embodiment, the first divided voltage RDCOM1 and the second divided voltage RDCOM2 may be changed in every two dots. For example, the first divided voltage RDCOM1 and the second divided voltage RDCOM2 may be changed in a cycle of a width of two gate signals.

For example, the first divided voltage RDCOM1 has a first level corresponding to high durations of the first and second gate signals GS1 and GS2, and a second level corresponding to high durations of the third and fourth gate signals GS3 and GS4. The second divided voltage RDCOM2 has a third level corresponding to high durations of the first and second gate signals GS1 and GS2, and a fourth level corresponding to high durations of the third and fourth gate signals GS3 and GS4.

For example, a width of swing of the first divided voltage RDCOM1 may be substantially the same as a width of swing of the second divided voltage RDCOM2. Alternatively, the width of swing of the first divided voltage RCOM1 may be different from the width of swing of the second divided voltage RDCOM2.

For example, one of the first divided voltage RDCOM1 and the second divided voltage RDCOM2 may be greater than the common voltage LCCOM and the other may be less than the common voltage LCCOM in a moment.

According to the present example embodiment, the divided voltage applied to the low pixel is adjusted to set the gray level of the low pixel. The different divided voltages RDCOM1 and RDCOM2 are applied to the first low pixel and the second low pixel which are adjacent to each other so that a first low gray level and a second low gray level may be different from each other for the same data voltage. Thus, a side visibility of the display panel 100 may be improved.

In addition, one gray level may be represented using additional gray levels by the time division method. Thus, a side visibility of the display panel 100 may be more improved.

Figure 10:
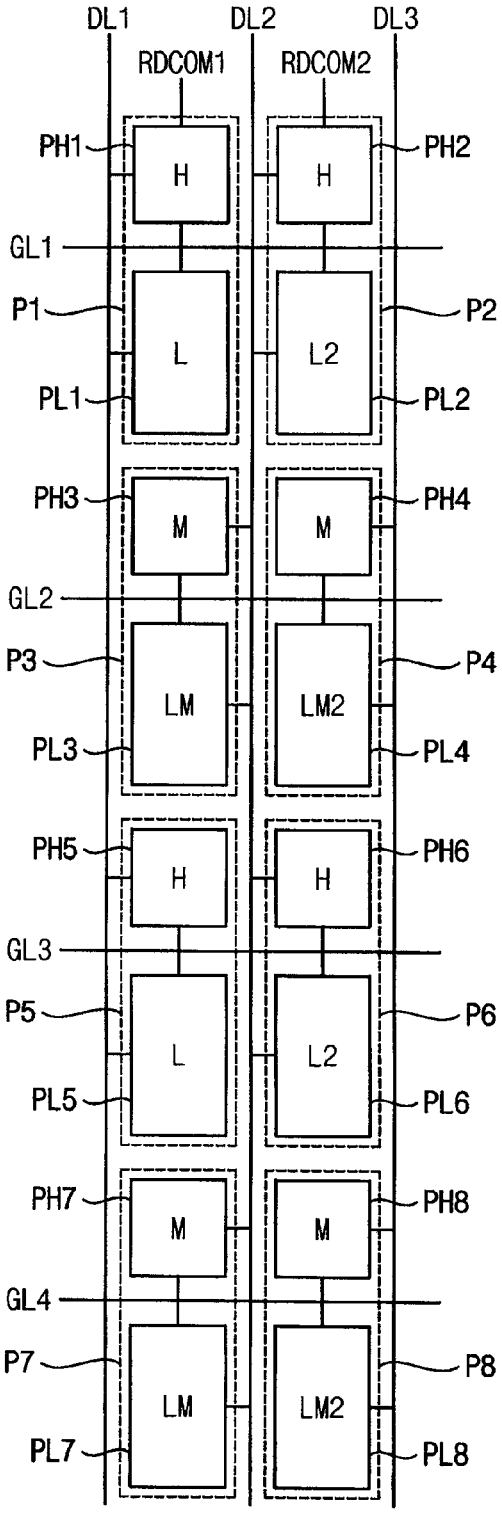
FIG. 10 is a plan view illustrating a pixel structure of a display panel according to an example embodiment of the present inventive concept.
Figure 11:
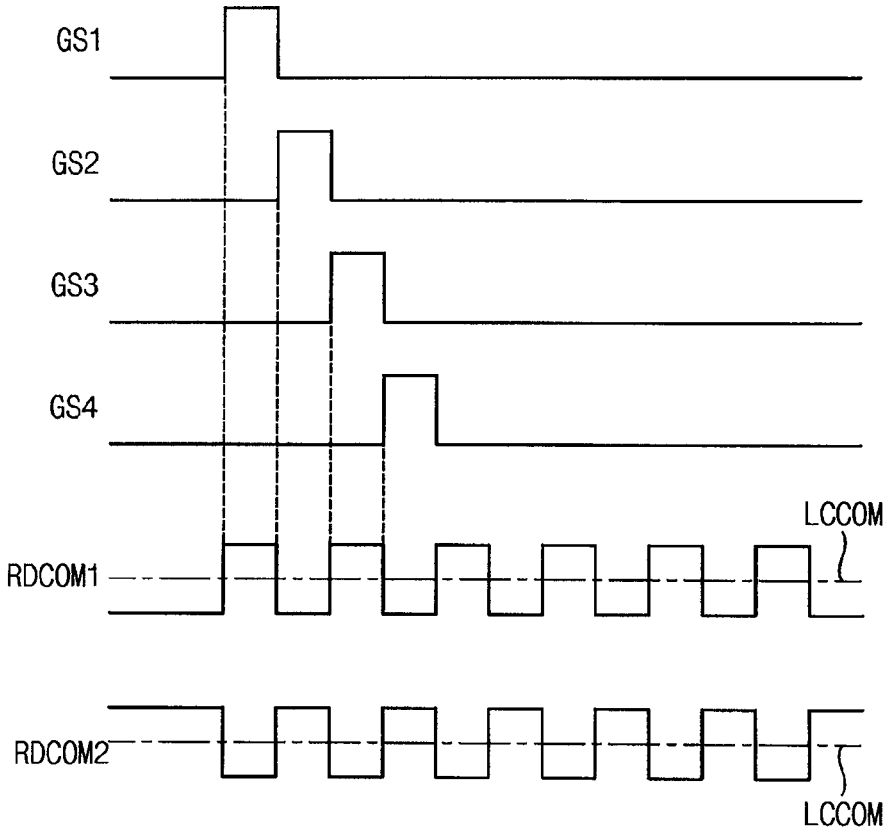
FIG. 11 is a waveform diagram illustrating a first divided voltage and a second divided voltage applied to the display panel of FIG. 10.

FIG. 10 is a plan view illustrating a pixel structure of a display panel according to an example embodiment of the present inventive concept. FIG. 11 is a waveform diagram illustrating a first divided voltage and a second divided voltage applied to the display panel of FIG. 10.

The display apparatus according to the present example embodiment is substantially the same as the display apparatus of the previous example embodiment explained referring to FIGS. 1 to 5 except for the pixel structure of the display panel and the waveforms of the first divided voltage and the second divided voltage. Thus, the same reference numerals will be used to refer to the same or like parts as those described in the previous example embodiment of FIGS. 1 to 5 and some repetitive explanation concerning the above elements will be omitted.

Referring to FIGS. 1, 2, 10 and 11, the display apparatus includes the display apparatus includes a display panel 100 and a panel driver. The panel driver includes a timing controller 200, a gate driver 300, a gamma reference voltage generator 400 and a data driver 500.

The display panel 100 includes a plurality of pixels. The pixel includes a high pixel and a low pixel.

The high pixel includes a high switching element TH, a high pixel electrode PH and a high liquid crystal capacitor CH.

The low pixel includes a first low switching element TLA, a second low switching element TLB, a low pixel electrode PL and a low liquid crystal capacitor CL.

In FIG. 10, eight pixels arranged in a four by two matrix form are illustrated.

A first pixel P1 includes a first high pixel PH1 and a first low pixel PL1. A second pixel P2 is adjacent to the first pixel P1 in the first direction D1. The second pixel P2 includes a second high pixel PH2 and a second low pixel PL2.

A third pixel P3 is adjacent to the first pixel P1 in the second direction D2. The third pixel P3 includes a third high pixel PH3 and a third low pixel PL3. A fourth pixel P4 is adjacent to the third pixel P3 in the first direction D1. The fourth pixel P4 includes a fourth high pixel PH4 and a fourth low pixel PL4.

A fifth pixel P5 is adjacent to the third pixel P3 in the second direction D2. The fifth pixel P5 includes a fifth high pixel PH5 and a fifth low pixel PL5. A sixth pixel P6 is adjacent to the fifth pixel P5 in the first direction D1. The sixth pixel P6 includes a sixth high pixel PH6 and a sixth low pixel PL6.

A seventh pixel P7 is adjacent to the fifth pixel P5 in the second direction D2. The seventh pixel P7 includes a seventh high pixel PH7 and a seventh low pixel PL7. An eighth pixel P8 is adjacent to the seventh pixel P7 in the first direction D1. The eighth pixel P8 includes an eighth high pixel PH8 and an eighth low pixel PL8.

For example, the pixels P1 to P8 may be arranged in one dot alternating structure.

The first pixel P1 is coupled to a first gate line GL1 applying a first gate signal, a first data line DL1 applying a first data voltage, and a first divided voltage line applying a first divided voltage RDCOM1.

The first high pixel PH1 represents a first high gray level based on the first data voltage and the common voltage LCCOM in response to the first gate signal.

The first low pixel PL1 represents a first low gray level based on the first data voltage, the common voltage LCCOM, and the first divided voltage RDCOM1 in response to the first gate signal.

The second pixel P2 is coupled to the first gate line GL1, a second data line DL2 applying a second data voltage, and a second divided voltage line applying a second divided voltage RDCOM2 different from the first divided voltage RDCOM1.

The second high pixel PH2 represents a second high gray level based on the second data voltage and the common voltage LCCOM in response to the first gate signal.

The second low pixel PL2 represents a second low gray level based on the second data voltage, the common voltage LCCOM and the second divided voltage RDCOM2 in response to the first gate signal.

The third pixel P3 is coupled to a second gate line GL2, the second data line DL2 and the first divided voltage line.

The fourth pixel P4 is coupled to the second gate line GL2, a third data line DL3 and applying a third data line and the second divided voltage line.

The fifth pixel P5 is coupled to a third gate line GL3, the first data line DL1 and the first divided voltage line.

The sixth pixel P6 is coupled to the third gate line GL3, the second data line DL2 and the second divided voltage line.

The seventh pixel P7 is coupled to a fourth gate line GL4, the second data line DL2 and the first divided voltage line.

The eighth pixel P8 is coupled to the fourth gate line GL4, the third data line DL3 and the second divided voltage line.

In the present example embodiment, the first divided voltage RDCOM1 applied to the first low pixel PL1 is different from the second divided voltage RDCOM2 applied to the second low pixel PL2. Thus, when the data voltages applied to the eight pixels P1 to P8 are substantially the same as one another, a gray level of the first high pixel PH1 may be substantially the same as a gray level of the second high pixel PH2. In contrast, when the data voltages applied to the eighth pixels P1 to P8 are substantially the same as one another, a gray level of the first low pixel PL1 may be different from a gray level of the second low pixel PL2.

In FIG. 10, for example, the data voltages applied to the eight pixels P1 to P8 are substantially the same as one another.

During a frame, the first high pixel PH1 represents a gray level of H, the first low pixel PL1 represents a gray level of L, the second high pixel PH2 represents the gray level of H and the second low pixel PL2 represents a gray level of L2. The third high pixel PH3 represents the gray level of M, the third low pixel PL3 represents a gray level of LM, the fourth high pixel PH4 represents the gray level of M and the fourth low pixel PL4 represents a gray level of LM2. The fifth high pixel PH5 represents the gray level of H, the fifth low pixel PL5 represents the gray level of L, the sixth high pixel PH6 represents the gray level of H and the sixth low pixel PL6 represents the gray level of L2. The seventh high pixel PH7 represents the gray level of M, the seventh low pixel PL7 represents the gray level of LM, the eighth high pixel PH8 represents the gray level of M and the eighth low pixel PL8 represents a gray level of LM2.

During the next frame, the high pixel representing the gray level of H may represent the gray level of M, the high pixel representing the gray level of M may represent the gray level of H, the low pixel representing the gray level of L may represent the gray level of LM, the low pixel representing the gray level of LM may represent the gray level of L, the low pixel representing the gray level of L2 may represent the gray level of LM2 and the low pixel representing the gray level of LM2 may represent the gray level of L2.

However, the present inventive concept is not limited to the above-mentioned method. The first divided voltage RDCOM1 and the second divided voltage RDCOM2 may be properly adjusted so that the gray level in a next frame may be freely adjusted according to the first and second divided voltages RDCOM1 and RDCOM2.

The first to eighth pixels P1 to P8 of the display panel 100 may represent a gray level value using six gray levels of H, L, L2, M, LM, and LM2. In addition, the positions of the six gray levels may be changed according to the frames. Thus, the side visibility of the display panel 100 may be improved.

In the present example embodiment, the first divided voltage RDCOM1 and the second divided voltage RDCOM2 may be changed in every dot. For example, the first divided voltage RDCOM1 and the second divided voltage RDCOM2 may be changed in a cycle of a width of a gate signal.

For example, the first divided voltage RDCOM1 has a first level corresponding to high durations of the first and third gate signals GS1 and GS3 and a second level corresponding to high durations of the second and fourth gate signals GS2 and GS4. The second divided voltage RDCOM2 has a third level corresponding to high durations of the first and third gate signals GS1 and GS3 and a fourth level corresponding to high durations of the second and fourth gate signals GS2 and GS4.

For example, a width of swing of the first divided voltage RDCOM1 may be substantially the same as a width of swing of the second divided voltage RDCOM2. Alternatively, the width of swing of the first divided voltage RCOM1 may be different from the width of swing of the second divided voltage RDCOM2.

For example, one of the first divided voltage RDCOM1 and the second divided voltage RDCOM2 may be greater than the common voltage LCCOM, and the other may be less than the common voltage LCCOM at a particular moment.

According to the present example embodiment, the divided voltage applied to the low pixel is adjusted to set the gray level of the low pixel. The different divided voltages RDCOM1 and RDCOM2 are applied to the first low pixel and the second low pixel which are adjacent to each other so that a first low gray level and a second low gray level may be different from each other for the same data voltage. Thus, a side visibility of the display panel 100 may be improved.

In addition, one gray level may be represented using additional gray levels by the time division method. Thus, a side visibility of the display panel 100 may be more improved.

According to the present inventive concept as explained above, the side visibility of the display panel may be improved so that the display quality of the display apparatus may be improved.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and aspects of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures.

Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A display panel comprising:

a first pixel comprising:

a first high pixel configured to represent a first high gray level based on a first data voltage and a common voltage in response to a first gate signal; and a first low pixel configured to represent a first low gray level based on the first data voltage, the common voltage, and a first divided voltage in response to the first gate signal; and a second pixel adjacent the first pixel in a first direction, the second pixel comprising:

a second high pixel configured to represent a second high gray level based on a second data voltage and the common voltage in response to the first gate signal; and a second low pixel configured to represent a second low gray level based on the second data voltage, the common voltage, and a second divided voltage different from the first divided voltage in response to the first gate signal.

2. The display panel of claim 1, wherein the first high pixel comprises:

a first high pixel electrode; and a first high switching element coupled to:

a first gate line configured to apply the first gate signal;

a first data line configured to apply the first data voltage; and the first high pixel electrode, wherein the first low pixel comprises:

a first low pixel electrode;

a first low switching element coupled to the first gate line, the first data line, and the first low pixel electrode; and a second low switching element coupled to the first gate line, the first low pixel electrode, and a first divided voltage line configured to apply the first divided voltage.

3. The display panel of claim 2, wherein the first divided voltage line extends parallel to the first data line, and the first divided voltage line is between the first data line and a second data line.

4. The display panel of claim 3, wherein the first divided voltage line is at a same layer as the first data line and the second data line.

5. The display panel of claim 1, wherein the first divided voltage and the second divided voltage are changed for adjacent frames.

6. The display panel of claim 5, wherein when the first data voltage represents a same gray level as a gray level represented by the second data voltage, during a first frame, the first high pixel is configured to represent a gray level of H, the first low pixel is configured to represent a gray level of L that is less than the gray level of H, the second high pixel is configured to represent the gray level of H, and the second low pixel is configured to represent a gray level of L2 that is different from the gray level of L, and during a second frame, the first high pixel is configured to represent a gray level of M that is different from the gray level of H, the first low pixel is configured to represent a gray level of LM that is less than the gray level of M and different from the gray level of L, the second high pixel is configured to represent the gray level of M, and the second low pixel is configured to represent a gray level of LM2 that is different from the gray level of LM.

7. The display panel of claim 5, further comprising:

a third pixel comprising:

a third high pixel configured to represent a third high gray level based on a third data voltage and the common voltage in response to the first gate signal; and a third low pixel configured to represent a third low gray level based on the third data voltage, the common voltage, and the first divided voltage in response to the first gate signal; and a fourth pixel comprising:

a fourth high pixel configured to represent a fourth high gray level based on a fourth data voltage and the common voltage in response to the first gate signal; and a fourth low pixel configured to represent a fourth low gray level based on the fourth data voltage, the common voltage, and the second divided voltage in response to the first gate signal.

8. The display panel of claim 7, wherein when the first data voltage, the second data voltage, the third data voltage and the fourth data voltage represent a same gray level as one another, during a first frame, the first high pixel is configured to represent a gray level of H, the first low pixel is configured to represent a gray level of L that is less than the gray level of H, the second high pixel is configured to represent the gray level of H, the second low pixel is configured to represent a gray level of L2 that is different from the gray level of L, the third high pixel is configured to represent a gray level of M that is different from the gray level of H, the third low pixel is configured to represent a gray level of LM that is less than the gray level of M and different from the gray level of L, the fourth high pixel is configured to represent the gray level of M and the fourth low pixel is configured to represent a gray level of LM2 that is different from the gray level of LM, and during a second frame, the first high pixel is configured to represent the gray level of M, the first low pixel is configured to represent the gray level of LM, the second high pixel is configured to represent the gray level of M, the second low pixel is configured to represent the gray level of LM2, the third high pixel is configured to represent the gray level of H, the third low pixel is configured to represent the gray level of L, the fourth high pixel is configured to represent the gray level of H, and the fourth low pixel is configured to represent the gray level of L2.

9. The display panel of claim 1, wherein the first divided voltage and the second divided voltage are changed in a cycle having a width of two gate signals.

10. The display panel of claim 9, further comprising:

a third pixel, a fifth pixel, and a seventh pixel sequentially positioned along a second direction which crosses the first direction from the first pixel; and a fourth pixel, a sixth pixel, and an eighth pixel sequentially positioned along the second direction from the second pixel, and further comprising:

a first data line configured to apply the first data voltage and coupled to the first pixel and the third pixel; and a second data line configured to apply the second data voltage and coupled to the second pixel, the fourth pixel, the fifth pixel and the seventh pixel.

11. The display panel of claim 1, wherein the first divided voltage and the second divided voltage are changed in a cycle having a width of a gate signal.

12. The display panel of claim 11, further comprising:

a third pixel, a fifth pixel, and a seventh pixel sequentially positioned along a second direction which crosses the first direction from the first pixel;

a fourth pixel, a sixth pixel and an eighth pixel sequentially positioned along the second direction from the second pixel;

a first data line configured to apply the first data voltage and coupled to the first pixel and the fifth pixel; and a second data line configured to apply the second data voltage and coupled to the second pixel, the third pixel, the sixth pixel, and the seventh pixel.

13. The display panel of claim 1, wherein a cycle of swing of the first divided voltage is the same as a cycle of swing of the second divided voltage, and a width of swing of the first divided voltage is the same as a width of swing of the second divided voltage.

14. A method of driving a display panel, the method comprising:

displaying a first high gray level on a first high pixel based on a first data voltage and a common voltage in response to a first gate signal;

displaying a first low gray level on a first low pixel based on the first data voltage, the common voltage, and a first divided voltage in response to the first gate signal;

displaying a second high gray level on a second high pixel based on a second data voltage and the common voltage in response to the first gate signal; and displaying a second low gray level on a second low pixel based on the second data voltage, the common voltage, and a second divided voltage that is different from the first divided voltage in response to the first gate signal.

15. The method of claim 14, wherein the first high pixel comprises:

a first high pixel electrode;

a first high switching element coupled to:

a first gate line configured to apply the first gate signal;

a first data line configured to apply the first data voltage; and the first high pixel electrode, wherein the first low pixel comprises:

a first low pixel electrode;

a first low switching element coupled to the first gate line, the first data line, and the first low pixel electrode; and a second low switching element coupled to the first gate line, the first low pixel electrode, and a first divided voltage line configured to apply the first divided voltage.

16. The method of claim 14, wherein the first divided voltage and the second divided voltage are changed for adjacent frames.

17. The method of claim 16, wherein when the first data voltage represents a same gray level as the second data voltage, during a first frame, the first high pixel is configured to represent a gray level of H, the first low pixel is configured to represent a gray level of L that is less than the gray level of H, the second high pixel is configured to represent the gray level of H, and the second low pixel is configured to represent a gray level of L2 that is different from the gray level of L, and during a second frame, the first high pixel is configured to represent a gray level of M that is different from the gray level of H, the first low pixel is configured to represent a gray level of LM that is less than the gray level of M and different from the gray level of L, the second high pixel is configured to represent the gray level of M, and the second low pixel is configured, to represent a gray level of LM2 that is different from the gray level of LM.

18. The method of claim 14, wherein the first divided voltage and the second divided voltage are changed in a cycle having a width of two gate signals.

19. The method of claim 14, wherein the first divided voltage and the second divided voltage are changed in a cycle having a width of a gate signal.

20. The method of claim 14, wherein a cycle of swing of the first divided voltage is the same as a cycle of swing of the second divided voltage, and a width of swing of the first divided voltage is the same as a width of swing of the second divided voltage.

* * * * *